US009518545B2

(12) United States Patent
Wirkowski et al.

(10) Patent No.: US 9,518,545 B2
(45) Date of Patent: Dec. 13, 2016

(54) METHOD AND DEVICE FOR OPERATING AN INTERNAL COMBUSTION ENGINE

(71) Applicant: Continental Automotive GmbH, Hannover (DE)

(72) Inventors: Michael Wirkowski, Regensburg (DE); Christian Mey, Regensburg (DE); Christoph Klesse, Woerth A.D. Donau (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 20 days.

(21) Appl. No.: 14/427,506

(22) PCT Filed: Oct. 4, 2013

(86) PCT No.: PCT/EP2013/070704

§ 371 (c)(1),
(2) Date: Mar. 11, 2015

(87) PCT Pub. No.: WO2014/056798

PCT Pub. Date: Apr. 17, 2014

(65) Prior Publication Data

US 2015/0247480 A1 Sep. 3, 2015

(30) Foreign Application Priority Data

Oct. 11, 2012 (DE) ..... 10 2012 218 525

(51) Int. Cl.
*F02M 59/12* (2006.01)
*F02D 41/06* (2006.01)
(Continued)

(52) U.S. Cl.
CPC ..... *F02M 59/12* (2013.01); *F02D 41/062* (2013.01); *F02D 41/3836* (2013.01);
(Continued)

(58) Field of Classification Search
CPC ..... F02D 41/06; F02D 41/062; F02D 41/38; F02D 41/3809; F02D 41/3836; F02D 41/3845; F02M 39/02; F02M 51/04; F02M 55/025; F02M 59/12; F02M 59/42; F02M 59/102; F02M 63/02; F02M 63/0265
(Continued)

(56) References Cited

U.S. PATENT DOCUMENTS 6,035,828 A * 3/2000 Anderson ..... F02D 41/3845 123/446
6,318,343 B1 11/2001 Nakagawa et al. ..... 123/500
(Continued)

FOREIGN PATENT DOCUMENTS

DE 10127516 A1 12/2002 ..... F02D 41/06
DE 10115262 C2 4/2003 ..... F01L 1/34
(Continued)

OTHER PUBLICATIONS

International Search Report and Written Opinion, Application No. PCT/EP2013/070704, 10 pages, Feb. 27, 2014.

*Primary Examiner* — John Kwon
*Assistant Examiner* — Johnny H Hoang
(74) *Attorney, Agent, or Firm* — Slayden Grubert Beard PLLC

(57) ABSTRACT

An internal combustion engine has a pressure accumulator, a high-pressure pump, a controllable actuator, and camshaft. The high-pressure pump includes a pump piston movably arranged in a cylinder chamber. The pump piston is supported on the camshaft and thus influences an open volume of the cylinder chamber depending on a rotation of the camshaft. The cylinder chamber is hydraulically coupled to the pressure accumulator to pump the fluid into the pressure accumulator. The actuator drives the camshaft such that the camshaft rotates about the camshaft's longitudinal axis in a
(Continued)

specified angular range. The high-pressure pump is controlled prior to an expected motor start such that the high-pressure pump is in a self-priming operating state and the actuator is controlled such that the camshaft rotates about the camshaft longitudinal axis in the specified angular range at least once in a first direction and at least once in an opposite second direction.

18 Claims, 3 Drawing Sheets

(51) Int. Cl.

| | |
|---|---|
| ***F02D 41/38*** | (2006.01) |
| ***F02M 59/10*** | (2006.01) |
| ***F02M 59/42*** | (2006.01) |
| ***F02M 39/02*** | (2006.01) |
| ***F02M 51/04*** | (2006.01) |
| ***F02M 63/02*** | (2006.01) |

(52) U.S. Cl.
CPC ..... *F02D 41/3845* (2013.01); *F02M 39/02* (2013.01); *F02M 51/04* (2013.01); *F02M 59/102* (2013.01); *F02M 59/42* (2013.01); *F02M 63/0265* (2013.01)

(58) Field of Classification Search
USPC ..... 123/182.1, 445, 456, 478, 480, 490, 508
See application file for complete search history.

(56) References Cited

U.S. PATENT DOCUMENTS

| | | | | |
|---|---|---|---|---|
| 7,066,126 | B2 | 6/2006 | Tokuyasu et al. | 123/179.17 |
| 7,762,226 | B2 | 7/2010 | Schafer et al. | 123/182.1 |
| 8,315,780 | B2 * | 11/2012 | Toyohara | F02M 59/367 123/456 |
| 8,965,667 | B2 | 2/2015 | Sczomak et al. | 701/112 |
| 2008/0115770 | A1 * | 5/2008 | Merchant | F02M 59/102 123/508 |
| 2010/0095935 | A1 * | 4/2010 | Verner | F02M 39/00 123/456 |
| 2011/0295493 | A1 * | 12/2011 | Wilms | F02D 41/20 701/103 |

FOREIGN PATENT DOCUMENTS

| | | | | |
|---|---|---|---|---|
| DE | 102008008117 | A1 | 8/2009 | F01L 1/344 |
| DE | 102013211929 | A1 | 1/2014 | F02D 45/00 |
| EP | 1422416 | A1 | 5/2004 | F02D 41/30 |
| EP | 1457645 | A1 | 9/2004 | F01L 1/08 |
| JP | 2004324419 | A | 11/2004 | |
| JP | 2007077904 | A | 3/2007 | F02M 37/00 |
| WO | 2014/056798 | A1 | 4/2014 | F02D 41/06 |

* cited by examiner

METHOD AND DEVICE FOR OPERATING AN INTERNAL COMBUSTION ENGINE

CROSS-REFERENCE TO RELATED APPLICATIONS

This application is a U.S. National Stage Application of International Application No. PCT/EP2013/070704 filed Oct. 4, 2013, which designates the United States of America, and claims priority to DE Application No. 10 2012 218 525.9 filed Oct. 11, 2012, the contents of which are hereby incorporated by reference in their entirety.

TECHNICAL FIELD

The invention relates to a method and a device for operating an internal combustion engine.

BACKGROUND

Modern motor vehicles have internal combustion engines with direct fuel injection, wherein the fuel is injected at high pressure directly into the combustion chamber or, in the case of multi-cylinder internal combustion engines, into the combustion chambers. Such direct fuel injection requires a fuel supply device which provides pressurized fuel in all operating situations. Elements of said fuel supply device include the high-pressure pump, which brings the fuel to the required pressure level, and a pressure accumulator (rail), in which the fuel is stored at high pressure and from which fuel is supplied to the injection valves.

As part of the efforts made by automobile manufacturers to further reduce the fuel consumption and emissions of motor vehicles, new vehicle functions have been developed such as, for example, the automatic start-stop function, by means of which the internal combustion engine can be automatically shut down without intervention by a motor vehicle driver and can be automatically re-started for example by the accelerator or clutch pedal being depressed, without the ignition key or the starting button having to be operated. The shutdown of the internal combustion engine is in this case performed in particular in relatively long idle phases in which the drive power of the internal combustion engine is not required. In this way, considerable fuel savings can be achieved in particular in inner-city traffic with numerous stoppages at traffic signals.

Upon the starting of an internal combustion engine with fuel injection systems, the fuel must be at an adequately high pressure. In general, the adequately high pressure upon the starting of the engine must initially be generated, both after a relatively long shutdown phase and after a short shutdown phase, by the high-pressure pump which is mechanically coupled to the engine. During a starting phase, the engine of a motor vehicle is driven, without combustion, by a starter of the motor vehicle until a setpoint injection enable pressure is reached. It is to be expected that, owing to more stringent limit values with regard to particle emissions, the setpoint injection enable pressure will be increased further in future.

SUMMARY

One embodiment provides a method for operating an internal combustion engine which comprises a pressure accumulator, a high-pressure pump, a controllable actuator and a rotatably mounted camshaft with a longitudinal axis, wherein the high-pressure pump has a cylinder chamber and a pump piston which is arranged movably in the cylinder chamber and which is at least indirectly supported on the camshaft and thus influences a free volume of the cylinder chamber in a manner dependent on a rotation of the camshaft, the cylinder chamber of the high-pressure pump is hydraulically at least indirectly coupled to a pressure accumulator in order to deliver the fluid into the pressure accumulator, the actuator is designed and arranged to drive the camshaft such that the camshaft rotates in a first direction or in an opposite second direction in a predefined angle range about its longitudinal axis, and in which the method comprises the following steps: during a predefined time period prior to an expected engine start, the high-pressure pump is activated so as to adopt a self-priming operating state, and the actuator is activated such that the camshaft rotates at least once in the first direction and at least once in the second direction in the predefined angle range about its longitudinal axis.

In a further embodiment, the predefined time period lies immediately prior to the expected engine start.

In a further embodiment, during the predefined time period, the actuator is activated such that the camshaft rotates in each case initially in the first direction and subsequently in the second direction in the predefined angle range about its longitudinal axis several times until a predefined injection enable pressure prevails in the pressure accumulator.

In a further embodiment, the internal combustion engine has a variable valve drive and the camshaft is coupled to a gas inlet valve and/or to a gas outlet valve of a combustion chamber of the internal combustion engine, and the actuator is arranged and designed to control an opening and/or closing time of the gas inlet valve or gas outlet valve by driving and/or adjusting the camshaft.

In a further embodiment, the variable valve drive has an electric variable valve drive.

In a further embodiment, the high-pressure pump comprises a digitally switching high-pressure pump.

Another embodiment provides a device for operating an internal combustion engine, which device is designed for carrying out the method disclosed above.

BRIEF DESCRIPTION OF THE DRAWINGS

Example embodiments of the invention are explained in more detail below with reference to the drawings, in which.

DETAILED DESCRIPTION

Figure 1:
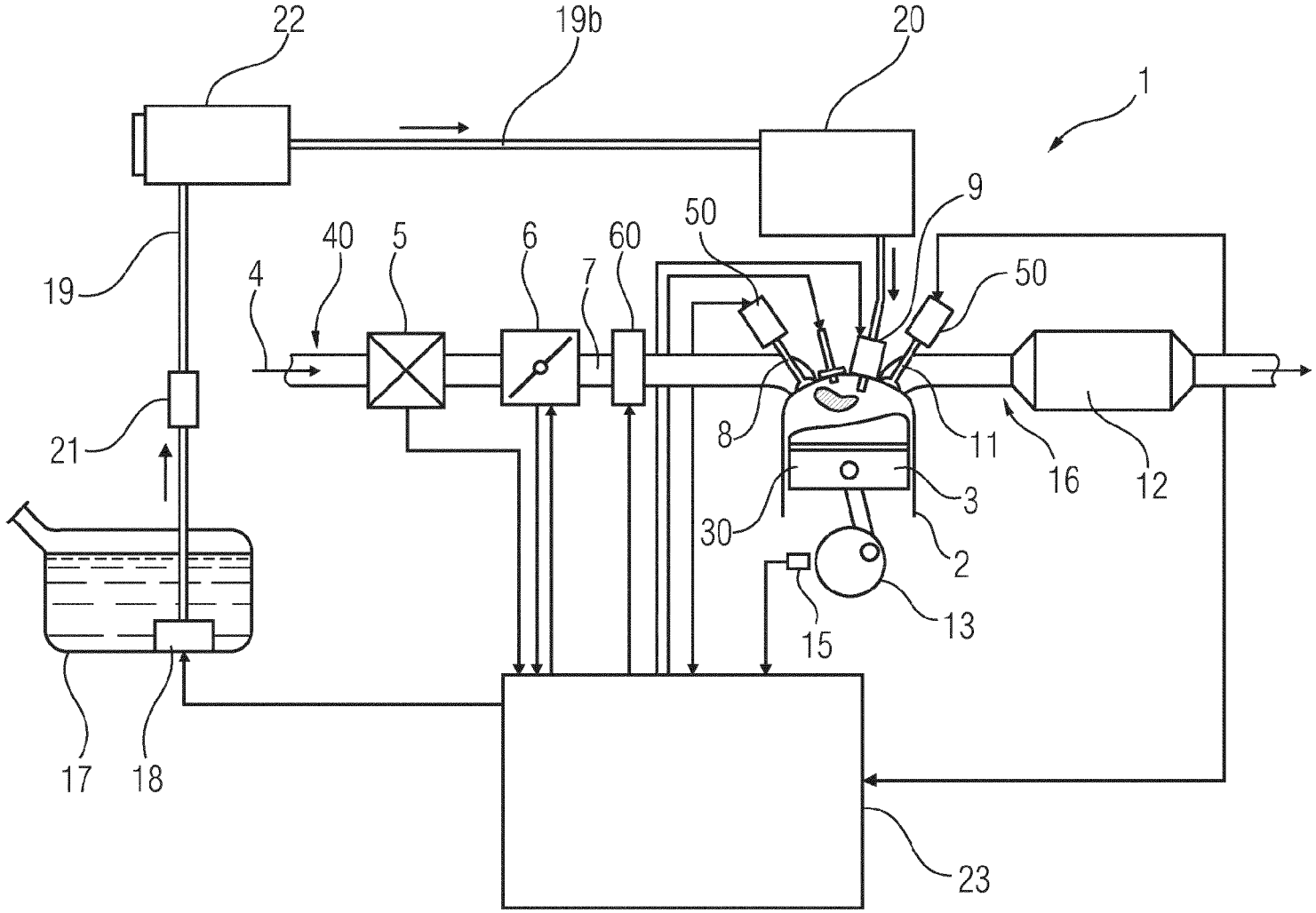
FIG. 1 is an exemplary schematic illustration of an internal combustion engine.

Embodiments of the invention provide a method and a device for operating an internal combustion engine, which method and device are conducive to improving an engine starting capability of the internal combustion engine.

Some embodiments provide a method and a corresponding device for operating an internal combustion engine. The internal combustion engine has a pressure accumulator, a high-pressure pump, a controllable actuator and a rotatably mounted camshaft with a longitudinal axis. The high-pressure pump comprises a cylinder chamber and a pump piston which is arranged movably in the cylinder chamber. The pump piston is at least indirectly supported on the camshaft and thus influences a free volume of the cylinder chamber in a manner dependent on a rotation of the camshaft. The cylinder chamber of the high-pressure pump is hydraulically at least indirectly coupled to the pressure accumulator in order to deliver the fluid into the pressure accumulator. The actuator is designed and arranged to drive the camshaft such that the camshaft rotates in a first direction or in an opposite second direction in a predefined angle range about its longitudinal axis. In this case, the method comprises the following steps: during a predefined time period prior to an expected engine start, the high-pressure pump is activated so as to adopt a self-priming operating state, and the actuator is activated such that the camshaft rotates at least once in the first direction and at least once in the second direction in the predefined angle range about its longitudinal axis.

This advantageously makes it possible for the camshaft and thus at least one drive cam of the camshaft to be rotated by means of the actuator, such that the high-pressure pump is driven, even prior to the expected engine start. In this case, the at least one drive cam, on which the pump piston is at least indirectly supported, of the camshaft is rotated back and forth. In this way, the pump piston performs suction and pumping stroke movements in the cylinder chamber. The suction and pumping stroke movements of the pump piston permit a delivery of fluid by the high-pressure pump, in particular a delivery of fuel, and thus a build-up of pressure in the pressure accumulator before the engine is started. The high-pressure pump is preferably designed such that, with suitable activation, it can adopt a self-priming operating state. This makes it possible for the high-pressure pump to very quickly assume an operational state, and to be usable in an effective manner. Furthermore, this makes it possible for the high-pressure pump to impart a full delivery action without synchronization of the camshaft and of a crankshaft. The high-pressure pump may be designed as a pump which is closed when deenergized or as a pump which is open when deenergized. In the event that the high-pressure pump is designed as a pump which is closed when deenergized, the high-pressure pump is operated without current. In the event that the high-pressure pump is designed as a pump which is open when deenergized, the high-pressure pump is operated with a permanent current, analogously to normal operation of the high-pressure pump in an active operating state of the engine. The expected engine start may be detected in a manner dependent on an opening of a vehicle driver's door and/or on seat occupancy. In the presence of an automatic start-stop function, the expected engine start can be determined in a manner dependent on an average short-term shutdown duration. The rotation of the camshaft for the purpose of building up the pressure in the pressure accumulator can be commenced in a manner dependent on the determined expected engine start. The pressure in the pressure accumulator can thus exhibit a desired value already when the actual starting of the engine takes place. This has the advantage in particular in a motor vehicle that a time period between an engine start desired by a vehicle driver and/or a vehicle-controlled engine start, at which for example an activation signal for the engine is generated in each case, and an actual start of combustion in the combustion chamber can be shortened. Even in the event of an increase in the setpoint injection enable pressure, it is possible, by way of the pressure build-up prior to the expected engine start, to maintain a size of the pressure accumulator without slowing the starting capability of the engine. A reduction in size of the pressure accumulator, with associated increased quality demands on further components, for example positive pressure valves and injectors, can be dispensed with.

In one embodiment, the predefined time period lies immediately prior to the expected engine start. This has the advantage that a pressure that has already been built up does not have to be held for a relatively long time, and/or particle emissions can be reduced, and/or possible leakage in the fuel system can be tolerated.

In a further embodiment, during the predefined time period, the actuator is activated such that the camshaft rotates in each case initially in the first direction and subsequently in the second direction in the predefined angle range about its longitudinal axis several times until a predefined injection enable pressure prevails in the pressure accumulator. This makes it possible to realize that the injection enable pressure already prevails upon starting of the engine, and an injection can be commenced already when a first top dead center of the engine is reached.

In a further embodiment, the internal combustion engine has a variable valve drive and the camshaft is coupled to a gas inlet valve and/or to a gas outlet valve of a combustion chamber of the internal combustion engine, and the actuator is arranged and designed to control an opening and/or closing time of the gas inlet valve or gas outlet valve by driving and/or adjusting the camshaft. It is thus advantageously possible for the actuator to be used for the variable valve drive and as a high-pressure pump drive. Operability of the variable valve drive is maintained as the actuator is utilized for the variable valve drive only once the engine has been started.

In a further embodiment, the variable valve drive comprises an electric variable valve drive. The variable valve drive may have an electric actuator. This advantageously makes it possible for the camshaft to very easily be rotated and/or driven when the engine is at a standstill.

In a further embodiment, the high-pressure pump comprises a digitally switching high-pressure pump. This advantageously permits a rapid build-up of pressure. Both directions of movement can be used for the build-up of pressure, as the build-up of pressure is independent of a respective direction of rotation.

The internal combustion engine 1 comprises at least one cylinder 2 and one piston 3 which is movable up and down in the cylinder 2. The internal combustion engine 1 furthermore comprises an intake tract 40 in which an air mass sensor 5, a throttle flap 6, a suction pipe 7 and a controllable charge-air cooler 60 are arranged downstream of an intake opening 4 for the intake of fresh air. The charge-air cooler 60 may in this case have a water-type cooling arrangement or an air-type cooling arrangement. The intake tract 40 opens out in a combustion chamber 30 which is delimited by the cylinder 2 and the piston 3. The fresh air required for the combustion is introduced into the combustion chamber 30 via the intake tract 40, wherein the supply of fresh air is controlled by opening and closing a gas inlet valve 8. The internal combustion engine 1 illustrated here is an internal combustion engine 1 with direct fuel injection, in which the fuel required for the combustion is injected directly into the combustion chamber 30 by means of an injection valve 9. An ignition plug 10 which likewise projects into the combustion chamber 30 serves for triggering the combustion. The combustion exhaust gases are discharged via a gas outlet valve 11 into an exhaust line 16 of the internal combustion engine 1, and purified by means of a catalytic converter 12 arranged in the exhaust line 16.

The transmission of power to the drivetrain (not illustrated) takes place via a crankshaft 13 which is coupled to the piston 3 and the rotational speed of which is detected by means of a rotational speed sensor 15.

The internal combustion engine 1 has a variable valve drive 50 by means of which the timing (opening and closing times) of the gas inlet valves 8 and of the gas outlet valves 11 can be individually adjusted. A camshaft 27 (not illustrated in FIG. 1) is coupled in each case to the gas inlet valve 8 and/or to the gas outlet valve and to the crankshaft 13. The internal combustion engine 1 may for example have an inlet camshaft and/or an outlet camshaft. The variable valve drive 50 is coupled to the camshaft 27 and to the crankshaft 13 and permits at least an adjustment of a phase of the camshaft 27 with respect to the crankshaft 13.

The variable valve drive 50 may for example be realized by a hydraulically adjustable camshaft (not illustrated in FIG. 1), with which the different timings of the valves 8, 11 are realized by switching between cams 28 with different elevation curves. However, an electric variable valve drive is also possible, in which the valves 8, 11 are individually electrically driven.

The variable valve drive 50 may for example have an actuator which is designed and arranged for driving the camshaft 27. The actuator is designed to drive the camshaft 27 such that the camshaft 27 rotates in a predefined angle range about its longitudinal axis in a first direction or in an opposite second direction. For example, the actuator may be designed to drive the camshaft 27 in a manner dependent on a predefined electrical impulse.

The internal combustion engine 1 furthermore has a fuel supply system which has a fuel tank 17 and a fuel pump 18 arranged therein. The fuel is supplied by means of the fuel pump 18 to a pressure accumulator 20 via a supply line 19, 19*a*. Such pressure accumulator is a common pressure accumulator from which pressurized fuel is supplied to the injection valves 9 for multiple cylinders 2. A fuel filter 21 and a high-pressure pump 22 are also arranged in the supply line 19. The high-pressure pump 22 serves for supplying the fuel, which is delivered by the fuel pump 18 at relatively low pressure (approximately 3 bar) to the pressure accumulator 20 at high pressure (typically up to 150 bar).

The internal combustion engine 1 is assigned a control device 23 which is connected via signal and data lines to all of the actuators and sensors of the internal combustion engine 1.

Figure 2:
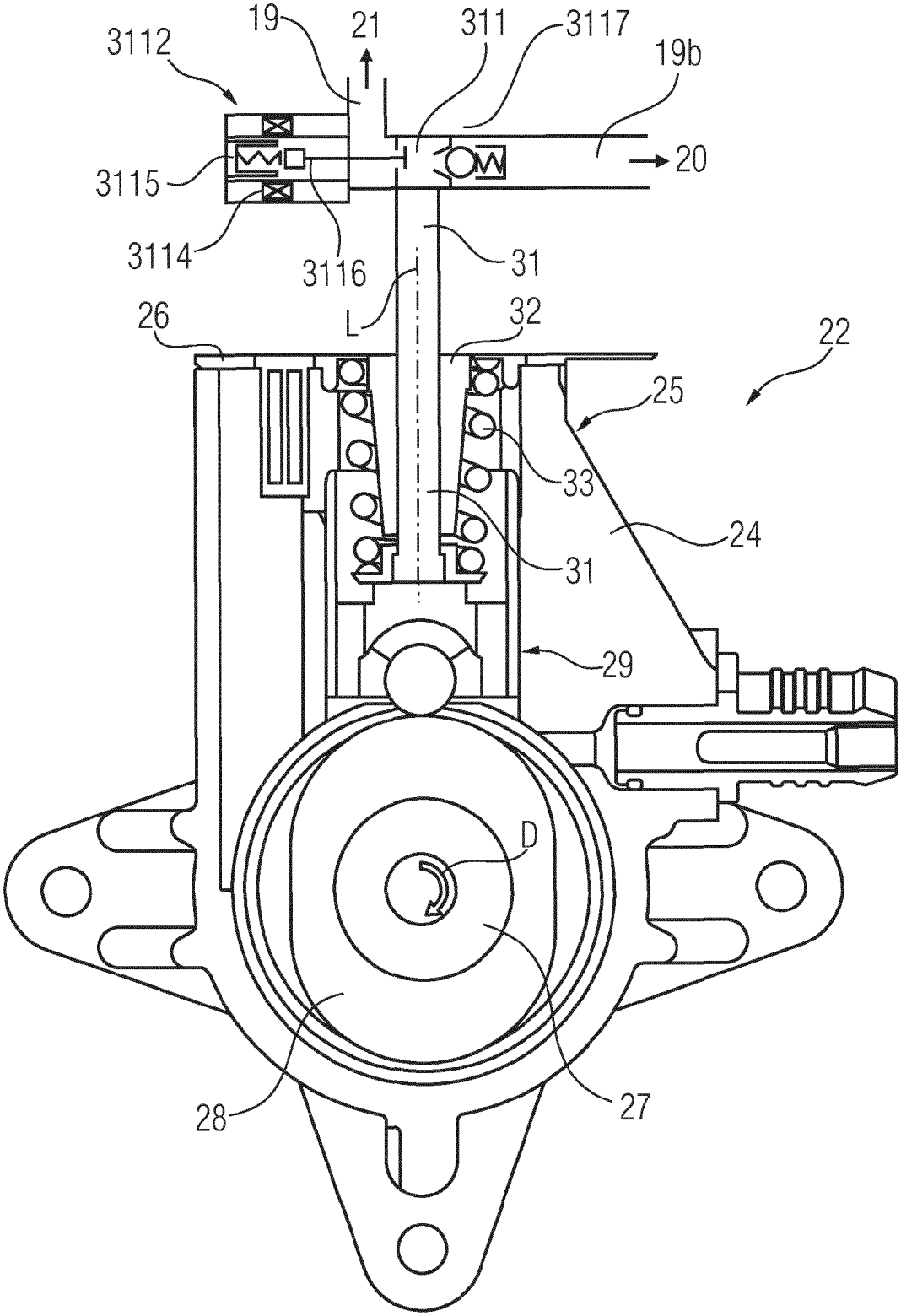
FIG. 2 shows a schematic partial view of a high-pressure pump in a longitudinal section.

FIG. 2 shows, at least in part, the high-pressure pump 22 with a pump housing 25 and a pump unit 25. The high-pressure pump 22 comprises, for example, a digitally switching high-pressure pump.

The illustrated pump unit 25 is preferably one of several pump units 25 of the high-pressure pump 22 which are operated by a commonly utilized drive shaft. The drive shaft is preferably the camshaft 27 which is coupled to the gas inlet valve 8 and/or to the gas outlet valve 11.

The camshaft 27 is for example mounted rotatably, with an axis of rotation D, in the pump housing 25. In the exemplary embodiment shown, the camshaft 27 comprises at least one cam 28, wherein the cam 28 may also be in the form of a multiple cam. In the exemplary embodiment shown in FIG. 2, the camshaft 27 has two cams 28. The number of delivery and compression strokes can be predefined by way of the number of cams 28. The number of delivery and compression strokes corresponds in this case to the number of cams 28.

The pump unit 25 comprises substantially the cylinder housing 26, the cylinder chamber 311 arranged in the cylinder housing 26, a pump piston 31, a plunger 29 and a restoring spring 33. The cylinder housing 26, the cylinder chamber 311, the pump piston 31, the plunger 29 and the restoring spring 33 are preferably arranged coaxially with respect to one another along a longitudinal axis L of the pump piston 31.

The pump piston 31 is mounted in axially movable fashion in the cylinder chamber 311 of the cylinder housing 26 in a cylindrical recess of a pump piston guiding section 32 of the cylinder housing 26, and is operatively connected to the camshaft 27. The pump piston 31 is in particular driven in a reciprocating motion in an at least approximately radial direction with respect to the axis of rotation D of the camshaft 27 by the cam 28 of the camshaft 27. The pump piston 31 is guided in axially movable fashion in the pump piston guiding section 32 in order that, during a suction stroke, which is directed downward in FIG. 2, it delivers fuel from the supply line 19 into the cylinder chamber 311 via the pump inlet valve 3112 while the pump outlet valve 3117 is closed and, during a pumping stroke, which is directed upward in FIG. 2, it compresses the fuel situated in the cylinder chamber 311 and discharges it at high pressure, if appropriate via the pump outlet valve 3117, into the supply line 19*a* to the pressure accumulator 20 while the pump inlet valve 3112 is closed.

FIG. 2 shows a possible embodiment of a pump inlet valve 3112 as a digitally switchable valve. It is what is known as a valve which is open when deenergized. By means of an electrical coil 3114 of the valve, a valve plunger 3116 with a valve closing element can be actively moved, counter to the force of a spring 3115, into a closed position of the valve 3112, in which no fuel can pass from the supply line 19 into the cylinder chamber 311 of the pump 22 or vice versa. When the coil 3114 is not energized, the valve 3112 is situated in its open position, and fuel can be drawn in from the supply line 19 in a suction phase of the pump 22. In a self-priming operating mode, in the case of this inlet valve type, the coil is not energized. Alternatively, a different valve principle could be used, with corresponding differences with regard to the self-priming operating mode.

In the embodiment shown, the pump outlet valve 3117 of the pump 22 is a check valve 3118 which, in the presence of a correspondingly high pressure in the cylinder chamber 311 of the pump, allows fluid to be delivered into the supply line 19*a* to the high-pressure accumulator 20.

Figure 3:
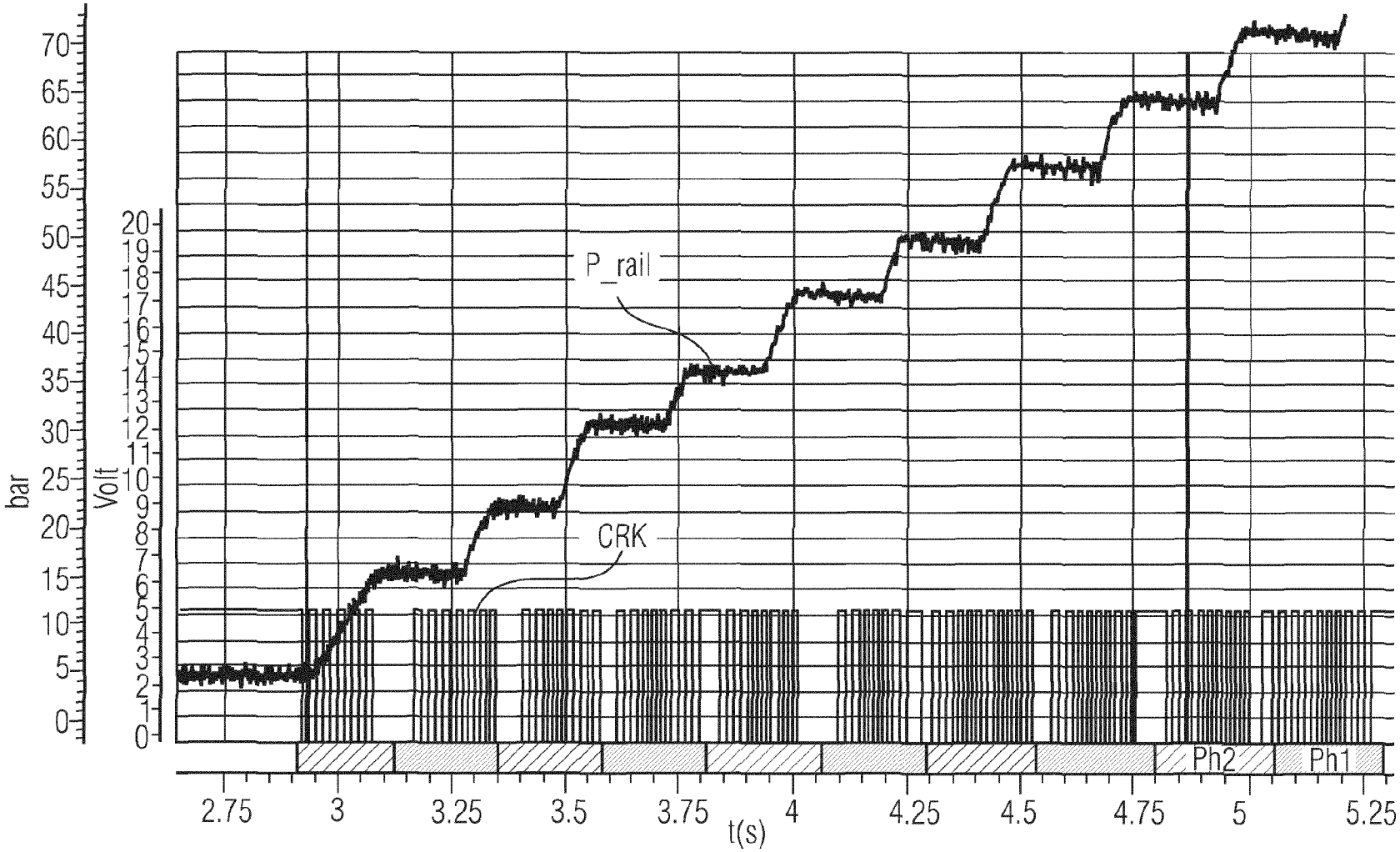
FIG. 3 shows a profile with respect to time of a rail pressure in a pressure accumulator and of a crankshaft signal.

FIG. 3 shows a profile with respect to time of a rail pressure P_rail in the pressure accumulator 20.

To build up a desired rail pressure P_rail in the pressure accumulator 20, it is the case even prior to an expected engine start that, during a predefined time period, the high-pressure pump 22 is activated so as to adopt a self-priming operating state, and the actuator is activated such that the camshaft 27 rotates at least once in the first direction and at least once in the second direction in the predefined angle range about its longitudinal axis.

In the example shown in FIG. 3, during the predefined time period, the actuator is activated such that the camshaft 27 rotates in each case initially in the first direction and subsequently in the second direction in the predefined angle range about its longitudinal axis several times. This may be performed until a predefined injection enable pressure prevails in the pressure accumulator 20.

Before the engine, for example of the motor vehicle, is started, the camshaft 27 is moved back and forth, for example by means of the at least one actuator of the variable valve drive 50. The rail pressure P_rail rises in an at least approximately stepped fashion owing to the back-and-forth movements. The profile with respect to time of the rail pressure P_rail represents a test rig measurement. The rail pressure P_rail rises for example by approximately 7 to 10 bar in the case of a total camshaft rotation of 45° (22.5° in the first direction and 22.5° back in the second direction). In the example shown, the camshaft 27 was rotated with an angular speed of 75°/s. An injection enable pressure of greater than 60 bar can thus be attained within a time period of less than two seconds. The time period is also dependent on a design of the high-pressure pump 22.

Furthermore, FIG. 3 shows the profile with respect to time of a crankshaft signal CRK, which is detected for example by means of a crankshaft sensor (respective peak 6° crankshaft 13, 3° camshaft 27). FIG. 3 also shows the respective phases of the rotational movement in different directions. During a respective first phase Ph1, the rotation takes place in the first direction, and during a respective second phase Ph2, the rotation takes place in the second, opposite direction.

What is claimed is:

1. A method for operating an internal combustion engine including a pressure accumulator, a high-pressure pump, a controllable actuator and a rotatably mounted camshaft with a longitudinal axis, wherein (a) the high-pressure pump has a cylinder chamber and a pump piston arranged movably in the cylinder chamber and which is at least indirectly supported on the camshaft and thereby influences a free volume of the cylinder chamber based on a rotation of the camshaft, (b) the cylinder chamber of the high-pressure pump is hydraulically coupled to a pressure accumulator at least indirectly to deliver the fluid into the pressure accumulator, and (c) the actuator is configured to drive the camshaft such that the camshaft rotates in a first direction or in an opposite second direction in a predefined angle range about the longitudinal axis, wherein the method comprises:

during a predefined time period prior to an expected engine start, activating the high-pressure pump to adopt a self-priming operating state, and during the predefined time period, activating the actuator such that the camshaft rotates at least once in the first direction and at least once in the second direction in the predefined angle range about the longitudinal axis.

2. The method of claim 1, wherein the predefined time period is immediately prior to the expected engine start.

3. The method of claim 1, comprising, during the predefined time period, activating the actuator such that the camshaft rotates initially in the first direction and subsequently in the second direction in the predefined angle range about its longitudinal axis several times until a predefined injection enable pressure in the pressure accumulator is reached.

4. The method of claim 1, wherein the internal combustion engine has a variable valve drive and the camshaft is coupled to at least one of a gas inlet valve and a gas outlet valve of a combustion chamber of the internal combustion engine, and wherein the actuator is configured to control at least one of an opening time and a closing time of the gas inlet valve or gas outlet valve by at least one of driving and adjusting the camshaft.

5. The method of claim 4, wherein the variable valve drive has an electric variable valve drive.

6. The method of claim 1, wherein the high-pressure pump comprises a digitally switching high-pressure pump.

7. A device for operating an internal combustion engine including a pressure accumulator, a high-pressure pump, a controllable actuator and a rotatably mounted camshaft with a longitudinal axis, wherein (a) the high-pressure pump has a cylinder chamber and a pump piston arranged movably in the cylinder chamber and which is at least indirectly supported on the camshaft and thereby influences a free volume of the cylinder chamber based on a rotation of the camshaft, (b) the cylinder chamber of the high-pressure pump is hydraulically coupled to a pressure accumulator at least indirectly to deliver the fluid into the pressure accumulator, and (c) the actuator is configured to drive the camshaft such that the camshaft rotates in a first direction or in an opposite second direction in a predefined angle range about the longitudinal axis, wherein the devices is configured to:

during a predefined time period to an expected engine start, activate the high-pressure pump to adopt a self-priming operating state, and during the predefined time period, activate the actuator such that the camshaft rotates at least once in the first direction and at least once in the second direction in the predefined angle range about the longitudinal axis.

8. The device of claim 7, wherein the predefined time period is immediately prior to the expected engine start.

9. The device of claim 7, further configured to, during the predefined time period, activate the actuator such that the camshaft rotates initially in the first direction and subsequently in the second direction in the predefined angle range about its longitudinal axis several times until a predefined injection enable pressure in the pressure accumulator is reached.

10. The device of claim 7, wherein the internal combustion engine has a variable valve drive and the camshaft is coupled to at least one of a gas inlet valve and a gas outlet valve of a combustion chamber of the internal combustion engine, and wherein the actuator is configured to control at least one of an opening time and a closing time of the gas inlet valve or gas outlet valve by at least one of driving and adjusting the camshaft.

11. The device of claim 10, wherein the variable valve drive has an electric variable valve drive.

12. The device of claim 7, wherein the high-pressure pump comprises a digitally switching high-pressure pump.

13. An internal combustion engine, comprising:

a pressure accumulator, a high-pressure pump, a controllable actuator, a rotatably mounted camshaft with a longitudinal axis, wherein the high-pressure pump has a cylinder chamber and a pump piston arranged movably in the cylinder chamber and which is at least indirectly supported on the camshaft and thereby influences a free volume of the cylinder chamber based on a rotation of the camshaft, wherein the cylinder chamber of the high-pressure pump is hydraulically coupled to a pressure accumulator at least indirectly to deliver the fluid into the pressure accumulator, and wherein the actuator is configured to drive the camshaft such that the camshaft rotates in a first direction or in an opposite second direction in a predefined angle range about the longitudinal axis, and a controller configured to:

during a predefined time period prior to an expected engine start, activate the high-pressure pump to adopt a self-priming operating state, and during the predefined time period, activate the actuator such that the camshaft rotates at least once in the first direction and at least once in the second direction in the predefined angle range about the longitudinal axis.

14. The internal combustion engine of claim 13, wherein the predefined time period is immediately prior to the expected engine start.

15. The internal combustion engine of claim 13, wherein the controller is configured to, during the predefined time period, activate the actuator such that the camshaft rotates initially in the first direction and subsequently in the second direction in the predefined angle range about its longitudinal axis several times until a predefined injection enable pressure in the pressure accumulator is reached.

16. The internal combustion engine of claim 13, wherein the internal combustion engine has a variable valve drive and the camshaft is coupled to at least one of a gas inlet valve and a gas outlet valve of a combustion chamber of the internal combustion engine, and wherein the actuator is configured to control at least one of an opening time and a closing time of the gas inlet valve or gas outlet valve by at least one of driving and adjusting the camshaft.

17. The internal combustion engine of claim 16, wherein the variable valve drive has an electric variable valve drive.

18. The internal combustion engine of claim 13, wherein the high-pressure pump comprises a digitally switching high-pressure pump.

* * * * *